US008764002B2

(12) United States Patent
Isogai

(10) Patent No.: US 8,764,002 B2
(45) Date of Patent: Jul. 1, 2014

(54) IMAGE FORMING APPARATUS AND POST-PROCESSING METHOD

(71) Applicant: Kyocera Document Solutions Inc., Osaka (JP)

(72) Inventor: Yoji Isogai, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/853,334

(22) Filed: Mar. 29, 2013

(65) Prior Publication Data

US 2013/0256969 A1 Oct. 3, 2013

(30) Foreign Application Priority Data

Mar. 30, 2012 (JP) ..... 2012-078968

(51) Int. Cl.
*B65H 37/04* (2006.01)
*B65H 7/00* (2006.01)

(52) U.S. Cl.
USPC ..... 270/58.09; 270/58.07; 270/58.08

(58) Field of Classification Search
USPC ..... 270/52.18, 58.07, 58.08, 58.09; 399/407, 408, 410; 412/7, 33, 42
See application file for complete search history.

(56) References Cited

U.S. PATENT DOCUMENTS

| | | | | |
|---|---|---|---|---|
| 6,226,471 | B1 * | 5/2001 | Tsuzuki | 399/75 |
| 6,386,080 | B1 | 5/2002 | Okamoto et al. | |
| 7,878,495 | B2 * | 2/2011 | Nishimura et al. | 270/58.02 |
| 8,190,049 | B2 * | 5/2012 | Tanaka | 399/82 |
| 2009/0008852 | A1 * | 1/2009 | Kokura et al. | 270/18 |
| 2009/0269167 | A1 | 10/2009 | Iida et al. | |
| 2010/0254741 | A1 * | 10/2010 | Saitsu | 399/405 |
| 2011/0285071 | A1 * | 11/2011 | Miyake et al. | 270/58.07 |
| 2012/0069360 | A1 * | 3/2012 | Kawa | 358/1.9 |

FOREIGN PATENT DOCUMENTS

| | | |
|---|---|---|
| JP | 11-060041 | 3/1999 |
| JP | 2006-053235 | 2/2006 |
| JP | 2010-032803 | 2/2010 |

* cited by examiner

*Primary Examiner* — Leslie A Nicholson, III
(74) *Attorney, Agent, or Firm* — K&L Gates LLP

(57) ABSTRACT

An image forming apparatus includes a punching time measuring unit, a stapling time estimating unit, and a sheet-bundle interval time setting unit. The punching time measuring unit measures a punching processing time to perform punching processing. The stapling time estimating unit calculates an estimated stapling processing time to perform stapling processing by using the punching processing time measured by the punching time measuring unit. The sheet-bundle interval time setting unit sets a sheet-bundle interval time, which is a time from when the last sheet forming a sheet bundle subjected to the punching processing is fed until when the first sheet forming a subsequent sheet bundle subjected to the punching processing is fed.

8 Claims, 6 Drawing Sheets

IMAGE FORMING APPARATUS AND POST-PROCESSING METHOD

INCORPORATION BY REFERENCE

This application is based upon and claims the benefit of priority from the corresponding Japanese Patent Application No. 2012-078968, filed on Mar. 30, 2012, the entire contents of which are incorporated herein by reference.

BACKGROUND

The present disclosure relates to an image forming apparatus and a post-processing method. More particularly, the disclosure relates to an image forming apparatus and a post-processing method in which, when performing processing that includes punching processing and stapling processing, a sheet-bundle interval time can be optimized by utilizing a punching processing time and thereby makes it possible to decrease the processing time.

In a post-processing device (sheet processing device) including a stapler, which performs stapling processing on a sheet bundle placed on a predetermined processing tray, and which outputs the stapled sheets to a predetermined output tray, the interval between the last sheet of the sheet bundle which has been stapled and the first sheet of a subsequent sheet bundle is set to be a maximum time for performing stapling processing described in the specifications of the stapler.

In this manner, after stapling a sheet bundle on the processing tray and outputting the stapled sheet bundle to the output tray, a subsequent sheet is outputted to the processing tray. In this case, however, feeding the subsequent sheet does not start until the above-described maximum time has elapsed, thereby considerably decreasing the throughput of the post-processing device.

As a sheet processing device that can solve such a problem, the following sheet processing device (hereinafter referred to as a "first sheet processing device") is known. The first sheet processing device includes a sheet loading unit on which outputted sheets are loaded, a stapler that staples a sheet bundle loaded on the sheet loading unit, and a stapling operation time measuring unit that measures the stapling operation time of the stapler. The first sheet processing device also includes a controller that controls the interval between a preceding sheet bundle and a subsequent sheet bundle, to be outputted to the sheet loading unit, by considering the stapling operation time measured by the stapling operation time measuring unit. With this configuration, the stapling operation time of the stapler is measured by the stapling operation time measuring unit. Accordingly, the stapling operation time, which may vary in accordance with the sheet size or the position of the stapler, can be measured in real time. Then, the first sheet processing device controls the interval between a preceding sheet bundle and a subsequent sheet to be outputted to the sheet loading unit in accordance with the stapling operation time, thereby making it possible to optimize the interval between the preceding sheet and the subsequent sheet. With this configuration, the efficiency in loading sheets on the sheet loading unit can be improved, and also, the throughput of the first sheet processing device can be enhanced.

A sheet processing device (hereinafter referred to as a "second sheet processing device") is also known. The second sheet processing device includes a punching unit, that is located in a sheet feed path and punches a rear end of a sheet which is being fed, and a punching-unit moving unit that moves the punching unit in a direction intersecting with the sheet feed direction. The second sheet processing device also includes a sheet end detector that detects a side end of a sheet positioned in the sheet feed path, and a punching operation detector that detects that the punching unit is punching a sheet after moving from a punching-operation home position. Then, in the second sheet processing device, upon detection by the punching operation detector that the punching operation is finished, the punching-unit moving unit moves the punching unit in a direction intersecting with the sheet feed direction. With this configuration, when the punching unit is returned to the home position, after the punching operation detector has detected that the punching operation is finished, a standby operation for moving the punching unit to the home position in the direction intersecting with the sheet feed direction starts. With this operation, it is possible to decrease the sheet processing time and thereby to improve productivity in sheet processing.

The following image forming system is also known. The image forming system includes an image forming apparatus that outputs a recording sheet on which an image is formed to a post-processing device, and a plurality of post-processing devices interconnected to each other. Each of the post-processing devices has a path connected to a subsequent post-processing device. In this image forming system, post-processing can be performed on a recording sheet on which an image is formed by using one of the post-processing devices. In the image forming system, an image forming controller controls the sequentially switching between post-processing devices so that a set of recording sheets to be post-processed may be distributed to an associated post-processing device. The image forming controller determines the image forming standby time generated in the image forming apparatus between sets of recording sheets in accordance with the system configuration. With this configuration, in the image forming system including a plurality of interconnected post-processing devices and performing post-processing by using at least two of the post-processing devices, even if the system configuration is changed, control can be performed in accordance with the changed system configuration so that an appropriate post-processing device may be selected and an appropriate image forming standby time may be generated.

A bookbinding device for performing ring bookbinding is known. In this bookbinding device, punching processing is performed on a sheet or a sheet bundle by using a punching unit, and stitching processing is performed on punched holes with ring members by using a stitching unit, thereby performing ring bookbinding. This bookbinding device includes a unit for changing a sheet-bundle interval, which is an interval between the last sheet of a preceding bundle and the first sheet of a subsequent bundle, between a first mode in which punching processing and stitching processing are performed and a second mode in which only punching processing is performed. With the provision of this unit, the sheet-bundle interval can be set in accordance with the type of mode, that is, the first mode or the second mode, thereby improving the usability and the productivity when the two modes are used at the same time.

An image forming apparatus including the following post-processing device is also known. The post-processing device includes a post-processing unit that performs post-processing on a plurality of sheets on which images are formed, a post-processing calculator that calculates the timing at which an image will be formed on a sheet to be subjected to post-processing in accordance with the content of the post-processing which has been set in the image forming apparatus, and a timing informing unit that informs the image forming apparatus of the timing at which an image will be formed on the sheet, based on a calculation of the timing by the post-processing calculator. The image forming apparatus includes a post-processing setting unit that instructs a user to set the content of post-processing to be performed in the post-processing device, a post-processing-content informing unit that informs the post-processing device of the post-processing content which has been set by the post-processing setting unit, and a printer that forms an image on a sheet. The image forming apparatus also includes a sheet-position setting unit that sets a sheet at a predetermined position of the printer in accordance with the timing informed by the timing informing unit. With this configuration, since the image forming apparatus sets a sheet at a predetermined position of the printer in accordance with the timing informed by the timing informing unit, a sheet-bundle interval table is not necessary, and also, calculations which may be made by considering operating conditions in the image forming apparatus are not necessary. As a result, a sheet-bundle interval table can be omitted, and also, it is possible to provide an image forming apparatus including an easy-to-control post-processing device that can optimize the sheet-bundle interval.

In the above-described first post-processing device, for feeding a sheet of a subsequent bundle, the stapling operation time of an immediately preceding sheet bundle is utilized. In actuality, however, measurements of the stapling operation time of the immediately preceding sheet bundle have not been made in time before a sheet of a subsequent bundle is fed. This is due to the fact that, at the time when the stapling processing has finished, it is necessary that the first sheet of a subsequent sheet bundle have already reached the post-processing device.

Moreover, normally, the stapling operation time may vary, for one stapling operation, from several milliseconds to several tens of milliseconds depending on the type of sheet. The first sheet processing device, the second sheet processing device, the image forming system, the bookbinding device, and the image forming apparatus are not able to handle such a change in the stapling operation time occurring when the type of sheet is changed.

One of the setting conditions including the above-described stapling processing is a bookbinding processing condition that punching processing be performed all sheets forming a sheet bundle and stapling processing be performed all the punched sheets.

For both the stapling processing and punching processing, a brushed DC motor is used, and power is supplied to the brushed DC motor by using a low voltage (for example, 24 V). In both the stapling processing and punching processing, sheets are passed through by using a certain member. When stapling processing and punching processing are performed at the same time, the operating environment temperature is the same. Accordingly, if the time to perform punching processing is measured, it is possible to estimate the time to perform stapling processing by taking these factors into consideration. Then, if the feed timing (sheet-bundle interval) at which a sheet of a subsequent bundle will be fed is set based on the estimated time, the sheet-bundle interval time may be optimized in accordance with the type of sheet, and the entire bookbinding processing time may also be decreased.

SUMMARY

An image forming apparatus according to an embodiment of the present disclosure includes a post-processing device, a punching time measuring unit, a stapling time estimating unit, and a sheet-bundle interval time setting unit. The post-processing device performs a punching processing on a sheet on which an image is formed and a stapling processing on a sheet bundle consisting of a plurality of punched sheets. The punching time measuring unit measures the punching processing time to perform the punching processing. The stapling time estimating unit calculates an estimated stapling processing time to perform the stapling processing by using the punching processing time measured by the punching time measuring unit. The sheet-bundle interval time setting unit sets, by using the estimated stapling processing time, a sheet-bundle interval time, which is the time from when the last sheet forming a sheet bundle subjected to the punching processing is fed until when the first sheet forming a subsequent sheet bundle subjected to the punching processing is fed.

A post-processing method according to another embodiment of the present disclosure includes a method for an image forming apparatus including a post-processing device that performs a punching processing on a sheet on which an image is formed and a stapling processing on a sheet bundle consisting of a plurality of punched sheets. The post-processing method includes: measuring the time to perform the punching processing; calculating an estimated stapling processing time to perform the stapling processing by using the measured punching processing time; and setting, by using the estimated stapling processing time, a sheet-bundle interval time, which is the time from when the last sheet forming a sheet bundle subjected to the punching processing is fed until when the first sheet forming a subsequent sheet bundle subjected to the punching processing is fed.

Additional features and advantages are described herein, and will be apparent from the following Detailed Description and the figures.

DETAILED DESCRIPTION

An embodiment of an image forming apparatus which includes a post-processing device of the present disclosure will be described below with reference to the accompanying drawings. The following embodiment is merely an example of a concrete form of the present disclosure, and it is not intended to restrict the technical scope of the disclosure. The alphabet "S" appended before numeric characters in the flowcharts represents a step.

An image forming apparatus including a post-processing device according to an embodiment of the present disclosure will be described below.

Figure 1:
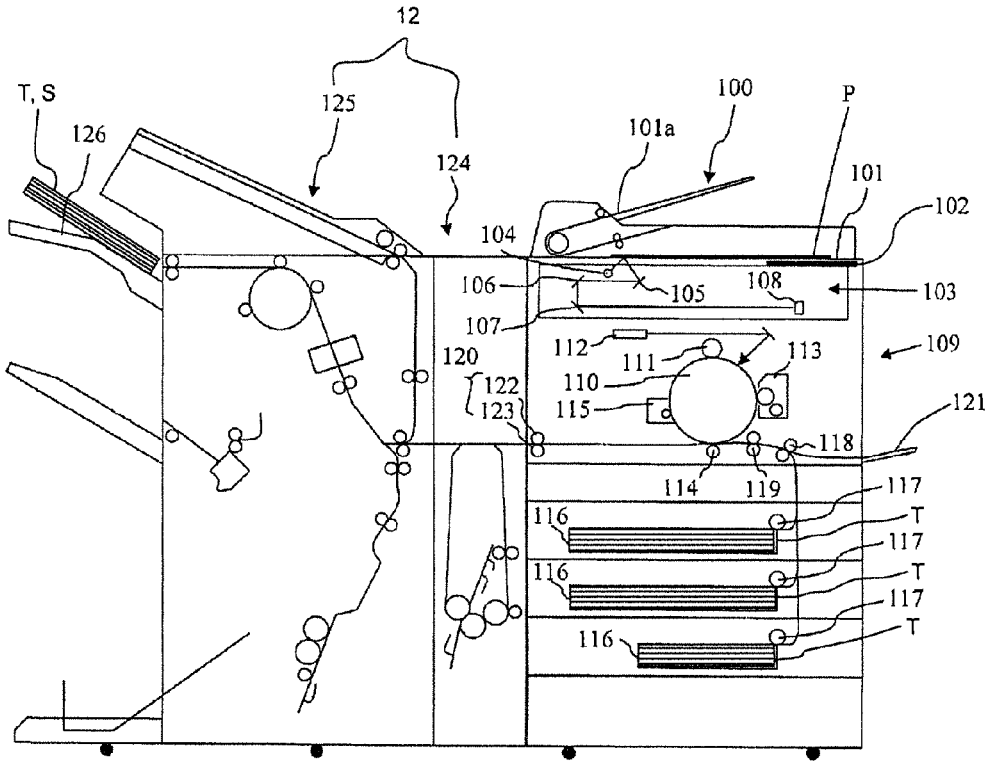
FIG. 1 illustrates a configuration of an image forming apparatus according to an embodiment of the present disclosure.

FIG. 1 illustrates a configuration of the image forming apparatus according to an embodiment of the present disclosure. In FIG. 1, details of the elements which are not directly related to the present disclosure are not shown. Examples of the image forming apparatus of an embodiment of the present disclosure are a single-function printer, a single-function scanner, or a multifunctional peripheral including a printer, a copying machine, a scanner, a fax machine, etc. having a printing function, a copying function, a scanning function, a fax function, etc. In this embodiment, it is assumed that a multifunctional peripheral 100 is used as the image forming apparatus.

A description will be briefly given of an operation performed in the multifunctional peripheral 100 when a user utilizes the copying function.

First, the user places a document P on a document table 101 or an automatic document feeder 101*a* located on the top surface of the multifunctional peripheral 100, and sets settings of a copying function by using an operation unit 102. On the operation unit 102, an operation screen, such as an initial screen, related to the copying function provided by the multifunctional peripheral 100 is displayed. On the operation screen, a plurality of setting item keys related to the copying function are displayed in a selectable manner. The user inputs setting conditions related to the copying function through the operation screen.

After having finished inputting setting conditions, the user presses a start key (not shown) located on the operation unit 102, thereby causing the multifunctional peripheral 100 to start copying.

When the multifunctional peripheral 100 has started copying, in an image reader 103, light emitted from a light source 104 is reflected by the document P placed on the document table 101. If multiple documents P are placed on the automatic document feeder 101*a*, the automatic document feeder 101*a* feeds the documents P one at a time to an image reading position of the image reader 103, and light emitted from the light source 104 to the image reading position is reflected by the document P.

The reflected light is introduced to an imaging element 108 through mirrors 105, 106, and 107. The light is then photoelectrically converted by the imaging element 108 and is subjected to basic correction processing, image quality processing, compression processing, etc., thereby generating image data corresponding to the document P.

A toner image is formed from the image data by an image forming unit 109. The image forming unit 109 includes a photoconductor drum 110 which rotates in a predetermined direction at a constant speed. Around the photoconductor drum 110, a charger 111, an exposure unit 112, a developing unit 113, a transfer unit 114, and a cleaning unit 115 are sequentially located from the upstream to downstream side in the rotating direction of the photoconductor drum 110.

The charger 111 uniformly charges the surface of the photoconductor drum 110. The exposure unit 112 irradiates the charged surface of the photoconductor drum 110 with a laser modulated based on the image data, thereby forming an electrostatic latent image on the surface of the photoconductor drum 110. The developing unit 113 causes toner to adhere to the electrostatic latent image formed on the photoconductor drum 110 so as to form a toner image (visualized image). The toner image is then transferred to a sheet T as a recording medium, by the transfer unit 114. The cleaning unit 115 removes excess toner remaining on the surface of the photoconductor drum 110. This process is performed while the photoconductor drum 110 is rotated.

The sheet T is fed from one of a plurality of feeder cassettes 116 located in the multifunction peripheral 100. When the sheet T is fed, it is picked up and supplied to the feed path from one of the feeder cassettes 116 using an associated pickup roller 117. The sheets T are stored in the feeder cassettes 116 according to the type of sheet T, and the sheet T is fed based on the above-described setting conditions.

The sheet T, supplied to the feed path, is fed between the photoconductor drum 110 and the transfer unit 114 by a pair of feed rollers 118 and a pair of registration rollers 119. Then, the toner image is transferred to the sheet T by the transfer unit 114, and then, the sheet T is fed to a fixing unit 120. The sheet T, fed by the pair of feed rollers 118, may be fed from a manual feeder tray 121 located in the multifunctional peripheral 100.

When the sheet T onto which the toner image has been transferred passes between a heating roller 122 and a pressurizing roller 123 located in the fixing unit 120, heat and pressure are applied to the toner image, thereby fixing the toner image (visualized image) on the sheet T. The quantity of heat applied to the heating roller 122 is optimally set in accordance with the type of sheet T, thereby performing an appropriate fixing operation. After fixing the visualized image on the sheet T, the image forming processing is finished. The sheet T, on which the visualized image is fixed, is fed to a folding device 124 via the fixing unit 120.

The fed sheet T is then subjected to a folding process in the folding device 124 in accordance with the setting conditions inputted by the user. If folding processing is not specified as the setting conditions, the sheet T then directly passes through the folding device 124.

Figure 3:
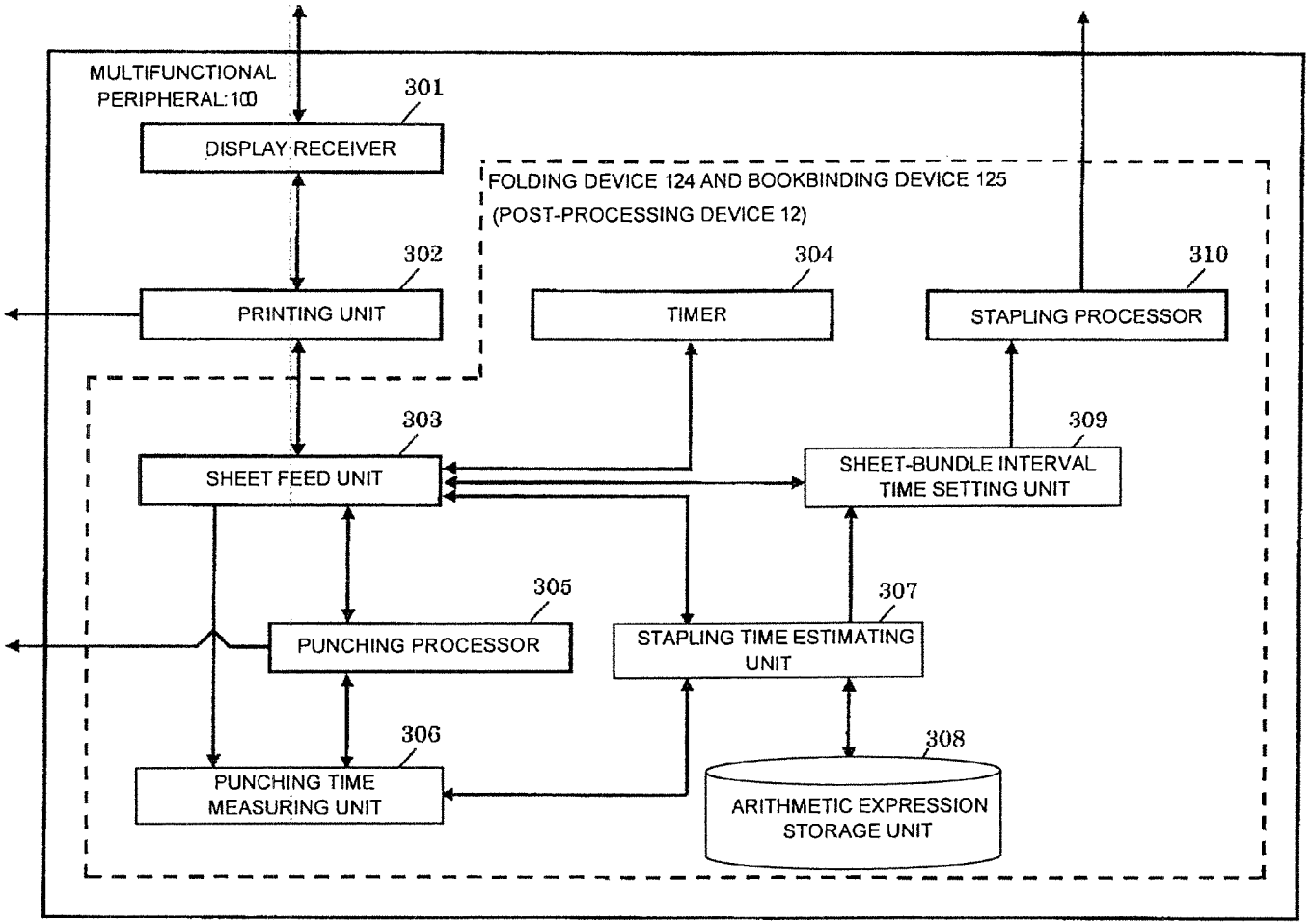
FIG. 3 is a functional block diagram illustrating an image forming apparatus according to an embodiment of the present disclosure.

If the user has specified post-processing (for example, stapling, punching, and bookbinding) as the setting conditions, the sheets T that passed through the folding device 124 are fed to a bookbinding device 125, and post-processing is performed on the sheets T. If, among the post-processing operations, bookbinding processing, for example, is performed, the bookbinding device 125 performs punching processing on each of the sheets T in a punching processor 305 (FIG. 3), and performs stapling processing on all the sheets T in a stapling processor 310 (FIG. 3). If bookbinding processing is performed on a plurality of bundles of sheets, in addition to a time difference between a current sheet T and a subsequent sheet T (sheet interval time), a time difference between a current sheet bundle S of a plurality of sheets T and a subsequent sheet bundle S (sheet-bundle interval time) is set. With this setting, bookbinding processing is smoothly performed for each sheet bundle S.

The motor used in the punching processor 305 and the motor used in the stapling processing 310 are the same type, that is, a brushed DC motor. Low voltage power is supplied to the brushed DC motor.

Sheets T or a sheet bundle S subjected to post-processing is loaded or stored in an output tray 126 of the bookbinding device 125. The folding device 124 and the bookbinding device 125 will be collectively referred to as a "post-processing device 12".

According to the above-described procedure, the multifunction peripheral 100 provides a copying function to the user.

Figure 2:
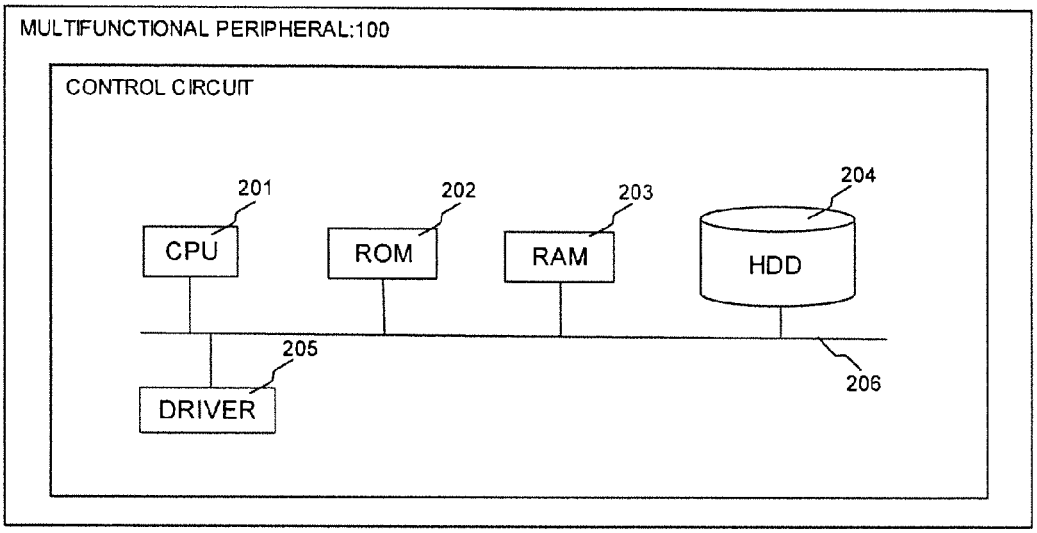
FIG. 2 illustrates a configuration of control-system hardware of an image forming apparatus according to an embodiment of the present disclosure.

The configuration of control-system hardware of the multifunctional peripheral 100 according to an embodiment of the present disclosure will be discussed below with reference to FIG. 2. In FIG. 2, details of the elements which are not directly related to the present disclosure are not shown.

A control circuit of the multifunctional peripheral 100 includes a central processing unit (CPU) 201, a read only memory (ROM) 202, a random access memory (RAM) 203, a hard disk drive (HDD) 204, and a driver 205. The driver 205 corresponds to the driving sections shown in FIG. 1. These elements are connected to one another via an internal bus 206. The CPU 201 executes a program stored in the ROM 202 or the HDD 204 using the RAM 203 as a work area, and receives data or sends instructions to and from the driver 205, the operation unit 102, the folding device 124, and the bookbinding device 125 based on the result obtained by executing the program, thereby controlling the operations of the driving sections shown in FIG. 1. Elements (shown in FIG. 3) other than these driving sections, which will be discussed later, are implemented based on the result obtained by executing the program by the CPU 201.

Figure 4:
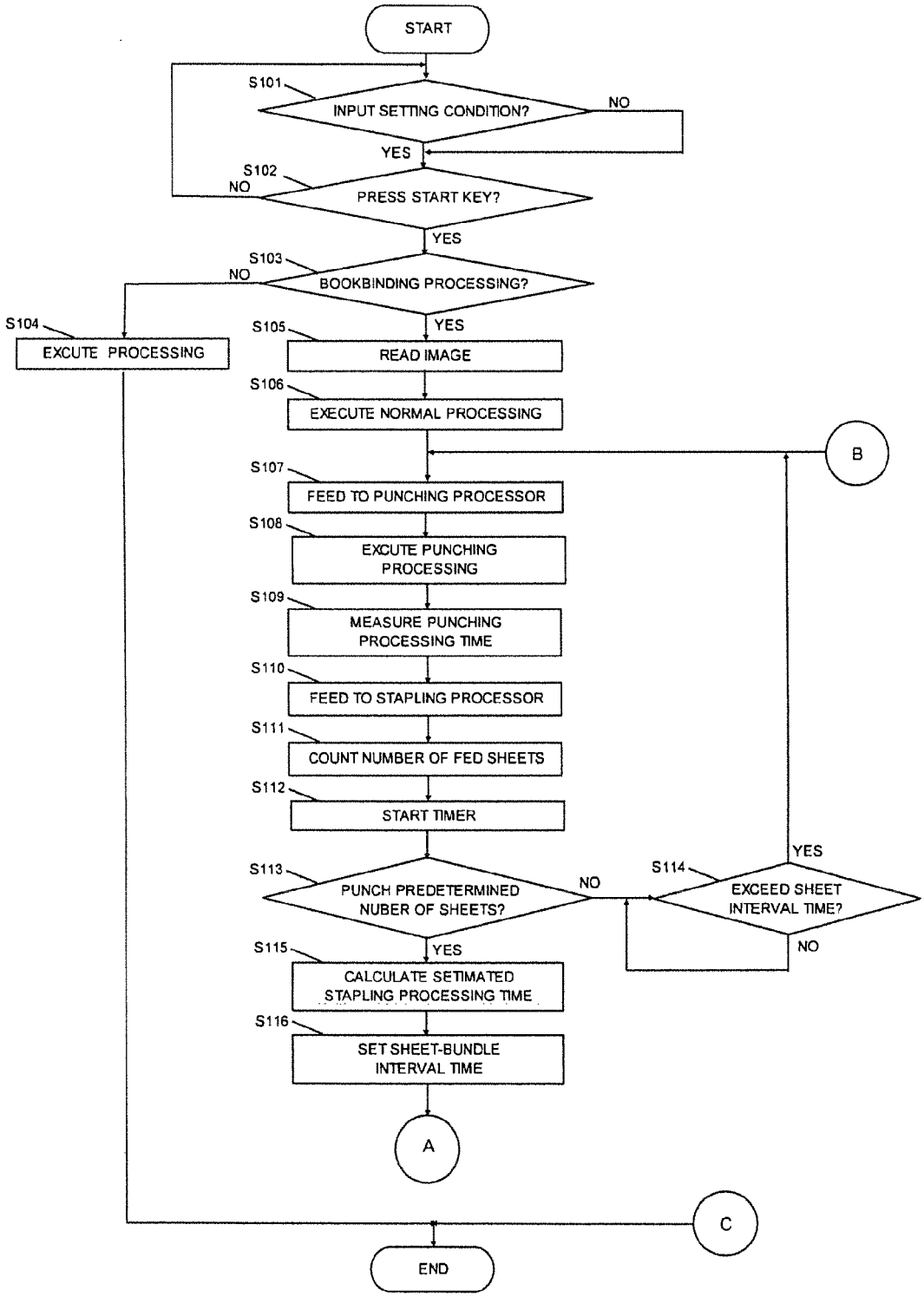
FIG. 4 is a first flowchart illustrating an execution procedure of bookbinding processing according to an embodiment of the present disclosure.
Figure 5:
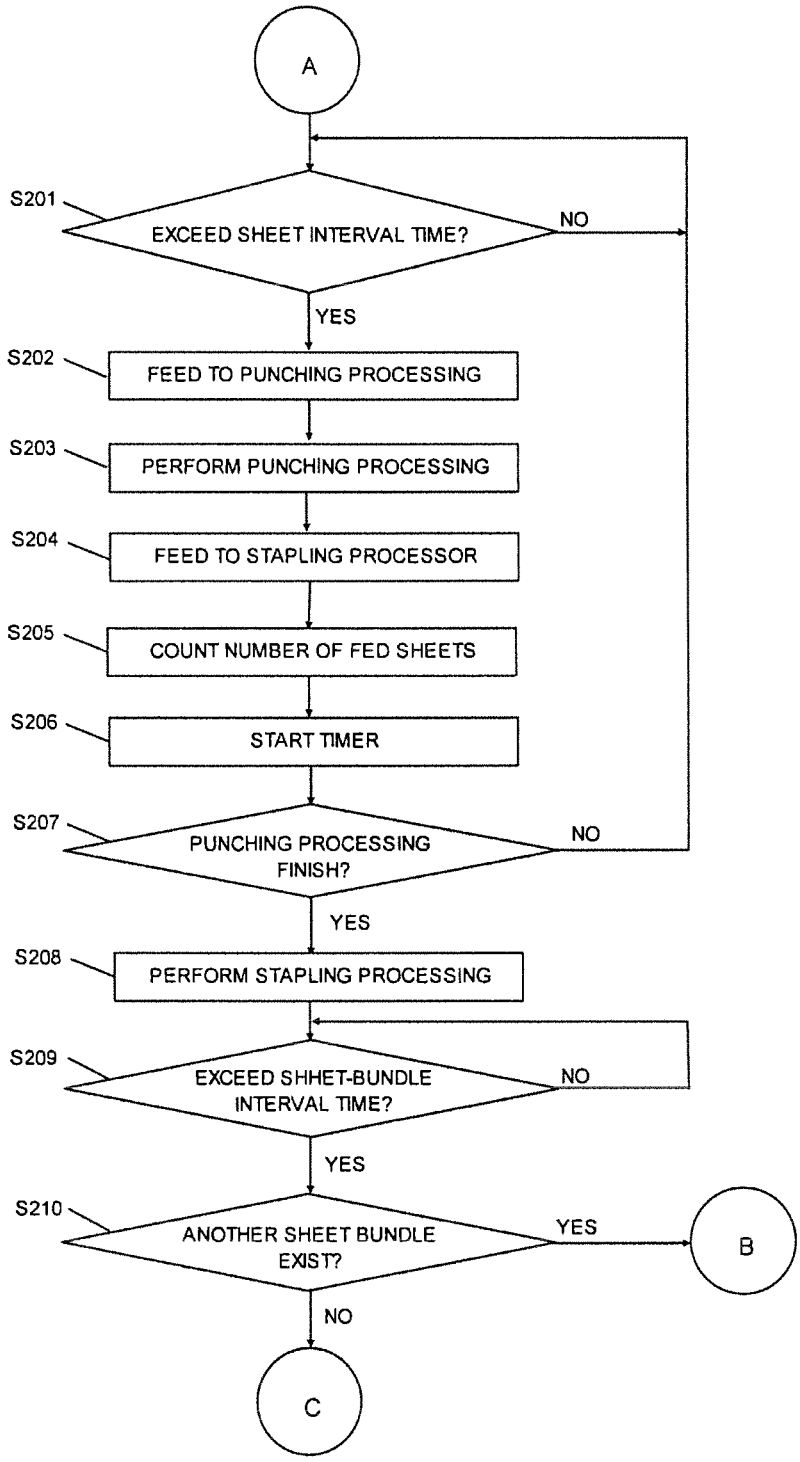
FIG. 5 is a second flowchart illustrating an execution procedure of bookbinding processing according to an embodiment of the present disclosure.

A configuration and an execution procedure according to an embodiment of the present disclosure will now be described below with reference to FIGS. 3 through 5. FIG. 3 is a functional block diagram illustrating the multifunctional peripheral of an embodiment of the present disclosure. FIGS. 4 and 5 are flowcharts illustrating an execution procedure of an embodiment of the present disclosure.

First, a user powers on the multifunctional peripheral 100. Then, the multifunctional peripheral 100 starts, and a display receiver 301 of the multifunctional peripheral 100 reads preset initial setting conditions and displays a preset initial screen (operation screen) on a touch panel of the operation unit 102.

The user places a predetermined number (for example, six) of documents P on the automatic document feeder 101*a* of the multifunctional peripheral 100 and inputs predetermined setting conditions into the multifunctional peripheral 100 by using the initial screen (FIG. 4: "YES" in S101).

In this case, as the predetermined setting conditions, sheet selection conditions, bookbinding processing conditions, and number-of-bundles conditions are inputted. As a sheet selection condition, the types of sheets T may be specified, for example, the first and last documents P are printed on thick paper and the remaining documents P are printed on plain paper. As the bookbinding processing conditions, the bookbinding processing type may be specified, for example, punching processing is performed on each sheet T, and stapling processing is performed on all the sheets T, thereby obtaining a bundle of sheets subjected to bookbinding processing. As the number-of-bundles conditions, the number of print sets (for example, three) may be specified.

Then, the user presses the start key of the operation unit 102 (FIG. 4: "YES" in S102). Then, the display receiver 301 receives the input of the setting conditions and depression of the start key, and informs a printing unit 302 that the input of the setting conditions and the depression of the start key have been received. Upon receiving such information, the printing unit 302 reads images formed on the documents P and performs printing (image formation) based on the setting conditions.

In this case, the printing unit 302 checks the setting conditions, and if the bookbinding processing conditions are not included in the setting conditions (FIG. 4: "NO" in S103), normal processing is performed. The printing unit 302 then reads images formed on the documents P and executes printing based on the setting conditions (FIG. 4: S104).

If the bookbinding processing conditions are included in the setting conditions (FIG. 4: "YES" in S103), the printing unit 302 reads images from the documents P one at a time by using the automatic document feeder 101*a*. The printing unit 302 then temporarily stores the plurality of read images corresponding to the plurality of documents P in a predetermined image memory (FIG. 4: S105), and also prints one (for example, the image which was first read) of the plurality of images on a sheet T (FIG. 4: S106).

Then, the printing unit 302 informs a sheet feed unit 303 of the bookbinding device 125 of the multifunctional peripheral 100 of the number of print sets (for example, three), the number of sheets T (for example, six) per print set (sheet bundle), and the number of currently printed sheets T (for example, one). Upon receiving such information, the sheet feed unit 303 feeds the printed sheet T to the punching processor 305 of the bookbinding device 125 (FIG. 4: S107).

The sheet feed unit 303 informs the punching processor 305 and a punching time measuring unit 306 that the printed sheet T has been fed to the punching processor 305. Upon receiving such information, the punching processor 305 executes predetermined punching processing based on the setting conditions on the sheet T fed to the punching processor 305 (FIG. 4: S108).

Upon receiving the information from the sheet feed unit 303, the punching time measuring unit 306 monitors the punching processor 305 and measures a punching processing time for the punching processor 305 to perform the punching processing (FIG. 4: S109).

This will be described more specifically. Normally, punching processing is performed such that a punched hole is created in the sheet T by one rotation of the brushed DC motor. Accordingly, by making the brushed DC motor one rotation, the punching processer 305 performs punching processing on the sheet T.

The punching time measuring unit 306 may measure the punching processing time in any manner. In the above-described configuration, for example, the punching time measuring unit 306 measures the time for the brushed DC motor to make one rotation, thereby measuring the punching processing time.

After the punching time measuring unit 306 has measured the punching processing time, the measured punching processing time is temporarily stored in a predetermined first memory (not shown).

After the punching processor 305 has finished the punching processing, the punching processor 305 informs the sheet feed unit 303 of the completion of the punching processing. Then, the sheet feed unit 303 feeds the punched sheet T to the stapling processor 310 of the bookbinding device 125 (FIG. 4: S110). Then, the sheet feed unit 303 increases the number of fed sheets, which has been set to the initial value, that is, 0, by one, and starts counting the number of fed sheets (FIG. 4: S111). Then, the sheet feed unit 303 starts a preset timer 304 and measures the time elapsed after the punched sheet T has been fed (FIG. 4: S112).

The sheet feed unit 303 then determines whether the counted number of fed sheets matches a predetermined number of sheets (for example, three) (FIG. 4: S113).

At the current time, since the number of fed sheet (one) does not match the predetermined number of sheets (three), the sheet feed unit 303 determines that the counted number of fed sheets does not match the predetermined number of sheets (FIG. 4: "NO" in S113). In this case, the sheet feed unit 303 obtains a sheet interval time (for example, several seconds) stored in a predetermined second memory (not shown). The sheet feed unit 303 also compares the elapsed time measured by the timer 304 with the sheet interval time and determines whether the elapsed time exceeds the sheet interval time (FIG. 4: S114).

The processing to be executed in a situation where the counted number of fed sheets matches the predetermined number of sheets (FIG. 4: "YES" in S113)) will be discussed later.

Figure 6A:
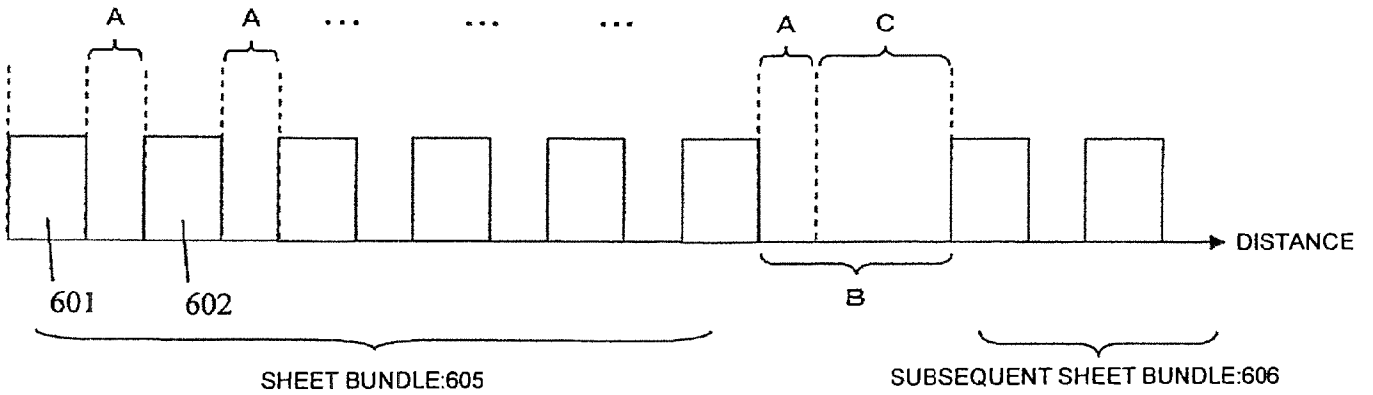
FIG. 6A illustrates a feed interval corresponding to a sheet interval time and a feed interval corresponding to a sheet-bundle interval time.

If it is determined that the elapsed time does not exceed the sheet interval time (FIG. 4: "NO" in S114), the sheet feed unit 303 enters the standby state. As a result, as shown in FIG. 6A, a predetermined feed interval A is provided between a punched (printed) sheet T601 and a next sheet T602, which will be subsequently fed. While the sheet feed unit 303 is in the standby state, for example, the printing unit 302 prints a subsequent image on a sheet T.

On the other hand, if it is determined in step S114 that the elapsed time exceeds the sheet interval time (FIG. 4: "YES" in S114), the sheet feed unit 303 stops the timer 304 and returns to step S107 in which it feeds the printed sheet T to the punching processor 305 (FIG. 4: S107). Then, the punching processor 305 performs punching processing on the printed sheet T (FIG. 4: S108), and the punching time measuring unit 306 measures the punching processing time (FIG. 4: S109). Then, the sheet feed unit 303 feeds the punched sheet T to the stapling processor 310 (FIG. 4: S110), increases the number of fed sheets by one (FIG. 4: S111), and restarts the timer 304 (FIG. 4: S112). If the number of fed sheets does not match the predetermined number of sheets (FIG. 4: "NO" in S113), the sheet feed unit 303 enters the standby state, and waits for a period equal to the sheet interval time counted from the time at which the punched sheet T has been fed (FIG. 4: S114). Then, the subsequent printing processing and the feeding of the subsequent sheet T are executed.

According to this procedure, the punching processing time is repeatedly measured until the counted number of fed sheets matches the predetermined number of sheets. Since the sheet feed unit 303 enters the standby state if the result of step S114 is NO, the feed interval A corresponding to the sheet interval time is provided between sheets T at regular intervals, as shown in FIG. 6A.

After repeating this procedure, if the counted number of fed sheets matches the predetermined number of sheets (FIG. 4: "YES" in S113), the sheet feed unit 303 informs a stapling time estimating unit 307 that the number of fed sheets has reached the predetermined number of sheets. Upon receiving such information, by using the punching processing time, the stapling time estimating unit 307 calculates the estimated stapling processing time to perform stapling processing which would be performed on a sheet bundle S subjected to the punching processing (FIG. 4: S115).

This will be more specifically discussed. The stapling time estimating unit 307 reads all the punching processing times measured by the punching time measuring unit 306 from the first memory, and calculates the average of the punching processing times.

Figure 6B:
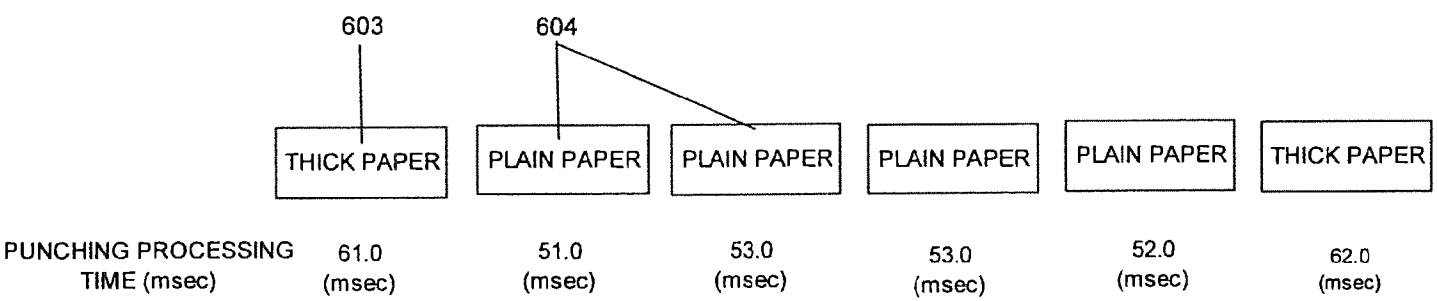
FIG. 6B illustrates the punching processing time measured for each of sheets forming a sheet bundle.

For example, as stated above, if, as the setting conditions, the sheet selection conditions are set such that the first and last documents P will be printed on thick paper and the remaining documents P will be printed on plain paper, and if, as shown in FIG. 6B, the punching processing time for the first sheet T603, which is thick paper, is 61.0 milliseconds (msec) and the punching processing times for the second and third sheets T604, which are plain paper, are 51.0 msec and 53.0 msec, respectively, and if the predetermined number of sheets is three, the average of the punching processing times is calculated to 55.0 msec. In FIG. 6B, the punching processing times for the remaining sheets T are shown for reference.

Then, the stapling time estimating unit 307 clears all the punching processing times from the first memory. The stapling time estimating unit 307 also obtains the number (six) of sheets T forming a sheet bundle S from the sheet feed unit 303 and refers to an arithmetic expression stored in an arithmetic expression storage unit 308. The stapling time estimating unit 307 then substitutes the average value of the punching processing times and the number of sheets T into the arithmetic expression so as to calculate the estimated stapling processing time. The arithmetic expression is given as follows.

$$Ts=(Ts0+\alpha*M)*Tpa/Tp0$$

In this expression, Ts (sec) is the above-described estimated stapling processing time, Ts0 (second per sheet) is a standard stapling processing time (for example, 46.0 msec per sheet) to perform predetermined stapling processing on one sheet T of plain paper, $\alpha$ is a coefficient (for example, 0.3) with respect to an increase in the stapling processing time per sheet, M is the number (six) of sheets forming a sheet bundle S, Tpa (sec) is an average (55.0 msec) of punching processing times, and Tp0 (*sec*) is a standard punching processing time (for example, 50.0 msec) to perform predetermined punching processing on one sheet T of plain paper.

The standard stapling processing time Ts0, the coefficient $\alpha$, and the standard punching processing time Tp0 are experimentally calculated values, which are respectively appropriately set in accordance with the type of stapling processor 310 and the type of punching processor 305 of the multifunctional peripheral 100.

As the number of sheets indicated by M increases to two, three, and so on, the actual stapling processing time does not simply increase to twice, three times, and so on. Accordingly, the coefficient $\alpha$ is used for reflecting the fact that Ts tends to gently increase with respect to the basic operating times (Ts0 and Tp0) in accordance with the number of sheets indicated by M. If M is considerably large, the coefficient $\alpha$ may be appropriately changed. For example, if M exceeds ten, the coefficient $\alpha$ may be changed from 0.3 to 0.5.

For example, the stapling time estimating unit 307 substitutes the average value (55.0 msec) of the punching processing times and the number (six) of sheets into the arithmetic expression, thereby calculating the estimated stapling processing time (52.58 msec).

Upon having calculated the estimated stapling processing time, the stapling time estimating unit 307 informs a sheet-bundle interval time setting unit 309 of the estimated stapling processing time. Upon receiving the estimated stapling processing time, by using the estimated stapling processing time, the sheet-bundle interval time setting unit 309 sets a sheet-bundle interval time, which is the time interval from the time at which the last sheet T forming the sheet bundle S has been fed until the first sheet T forming a subsequent sheet bundle S is fed (FIG. 4: S116).

More specifically, the sheet-bundle interval time setting unit 309 obtains the sheet interval time stored in the second memory, and also, adds the estimated stapling processing time (52.58 msec), as a sheet-bundle interval extra time, to the sheet interval time, thereby calculating a sheet-bundle interval time. The sheet-bundle interval time setting unit 309 then informs the sheet feed unit 303 of the calculated sheet-bundle interval time, and the sheet feed unit 303 sets the sheet-bundle interval time as a standby time, which is the period from the time at which the last sheet T forming the sheet bundle S has been fed until the time at which the first sheet T forming the subsequent sheet bundle S is fed (FIG. 4: S116).

In this manner, the sheet feed unit 303 is able to set the sheet-bundle interval time provided for each sheet bundle S in accordance with the estimated stapling processing time. As shown in FIG. 6A, a feed interval B corresponding to the sheet-bundle interval time is composed of a feed interval A corresponding to the sheet interval time and a feed interval C corresponding to the estimated stapling processing time (sheet-bundle interval extra time). Since the estimated stapling processing time reflected in the sheet-bundle interval time is calculated for the sheets T to be subjected to stapling processing by using the measured punching processing times, it can approximate to the actual stapling processing time (for example, 53.0 msec). Accordingly, an unnecessarily long sheet-bundle interval time does not have to be set, thereby optimizing the sheet-bundle interval time. That is, the productivity of the overall processing can be improved.

At the current time (FIG. 4: S116), punching processing has not yet been performed on the last sheet T forming the sheet bundle S, and the sheet interval time has not yet elapsed. Thus, the sheet feed unit 303 shifts to step S201 in FIG. 5, and waits until the time elapsed from the time at which the punched sheet T has been fed in step S110 exceeds the sheet interval time (FIG. 5: "NO" in S201). During this standby state, the subsequent printing processing and feeding of the subsequent sheet T are executed, as stated above.

If the time elapsed from the time at which the punched sheet T has been fed in step S110 exceeds the sheet interval time (FIG. 5: "YES" in S201), the sheet feed unit 303 feeds a printed sheet T to the punching processor 305 (FIG. 5: S202), as stated above, and the punching processor 305 performs punching processing on the fed sheet T (FIG. 5: S203). In this case, since the sheet-bundle interval time has already been set, the punching processing measuring unit 306 is not started.

Then, the sheet feed unit 303 feeds the punched sheet T to the stapling processor 310 (FIG. 5: S204), increases the number of fed sheets by one (FIG. 5: S205), and then restarts the timer 304 (FIG. 5: S206).

The sheet feed unit 303 then determines whether the number of fed sheets matches the number of sheets T forming the sheet bundle S, that is, whether punching processing has been performed on the last sheet T forming the sheet bundle S (FIG. 5: S207).

If the number of fed sheets does not match the number of sheets T forming the sheet bundle S (FIG. 5: "NO" in S207), the sheet feed unit 303 shifts to step S201 and waits until the sheet interval time has elapsed (FIG. 5: "NO" in S201), as stated above. The subsequent processing is similar to that described above, and an explanation thereof will thus be omitted.

If it is determined that the number of fed sheets matches the number of sheets T forming the sheet bundle S (FIG. 5: "YES" in S207), the sheet feed unit 303 informs the stapling processor 310 (see FIG. 3) that punching processing has been performed on the last sheet T forming the sheet bundle S. Upon receiving such information, the stapling processor 310 aligns both ends of the plurality of punched sheets T fed (stored) to (in) the stapling processor 310, that is, the sheet bundle S, and performs predetermined stapling processing based on the setting conditions on the sheet bundle S (FIG. 5: S208).

This will be more specifically described. Normally, stapling processing is performed such that a sheet bundle S is stapled by making the brushed DC motor one rotation. Accordingly, by making the brushed DC motor one rotation, the stapling processer 310 staples the sheet bundle S. The stapling processor 310 then outputs the stapled sheet bundle S to the output tray 126 of the bookbinding device 125. Then, bookbinding processing on the sheet bundle S has been completed.

The elapsed time which is measured by the timer 304, while the stapling processor 310 is performing processing, is the time elapsed from the time at which the last sheet T forming the sheet bundle S has been fed to the stapling processor 310. Accordingly, the sheet feed unit 303 determines whether the elapsed time exceeds the sheet-bundle interval time (FIG. 5: S209).

If the elapsed time does not exceed the sheet-bundle interval time (FIG. 5: "NO" in S209), the sheet feed unit 303 enters the standby state. In actuality, during this standby state, the stapling processor 310 performs predetermined stapling processing on a sheet bundle S (indicated by 605 in FIG. 6A). Additionally, during the standby state, as shown in FIG. 6A, the feed interval B is set between the sheet bundle S (indicated by 605 in FIG. 6A) and a sheet bundle S to be subsequently fed (indicated by 606 in FIG. 6A). With the setting of the feed interval B, disadvantages which would occur if the sheet-bundle interval time were shorter, that is, the occurrence of a paper jam caused by a collision of sheet bundles S, can be prevented. If there is another sheet bundle S (indicated by 606 in FIG. 6A) to be processed, the printing unit 302 prints the subsequent image on a sheet T.

If the elapsed time exceeds the sheet-bundle interval time (FIG. 5: "YES" in S209), the sheet feed unit 303 stops the timer 304, and also increases the counter number (the initial value is 0), which indicates the number of sheet bundles, by one. In this manner, the sheet feed unit 303 counts the number of sheet bundles every time one bundle has been stapled. Then, the sheet feed unit 303 determines whether the counter number matches the number (three) of bundles specified by the setting conditions. That is, the sheet feed unit 303 determines whether there is another sheet bundle to be processed (FIG. 5: S210).

At the current time, since the counter number (one) does not match the number (three) of bundles specified by the setting conditions, the sheet feed unit 303 determines that there is another sheet bundle to be processed (FIG. 5: "YES" in S210). The sheet feed unit 303 shifts to step S107 and feeds a sheet T printed by the printing unit 302 (the first sheet T of the subsequent sheet bundle S) to the punching processor 305 (FIG. 4: S107).

The sheet-bundle interval time has been set by using the estimated stapling processing time such that an excess standby time will not occur. Thus, as shown in FIG. 6A, processing to be performed on the subsequent sheet bundle S can be efficiently started after a period of a minimal interval so as to not cause interference with the immediately preceding sheet bundle S.

The processing after S107 is similar to that described above, and an explanation thereof will thus be omitted.

If it is determined in S210 that the counter number (three) matches the number (three) of bundles specified by the setting conditions, the sheet feed unit 303 determines that there is no sheet bundle to be processed (FIG. 5: "NO" in S210). Then, the sheet feed unit 303 clears the plurality of images temporarily stored in the image memory, and also clears the counter number. Then, the entire processing has been completed.

As described above, the multifunctional peripheral 100 of the above-described embodiment includes the punching time measuring unit 306 that measures the time to perform the punching processing, and the stapling time estimating unit 307 that calculates, by using the measured punching processing time, an estimate of the time to perform stapling which would be performed on a sheet bundle S subjected to the punching processing. The multifunctional peripheral 100 also includes the sheet-bundle interval time setting unit 309 that sets, by using the estimated stapling processing time, a sheet-bundle interval time, which is a time interval from the time at which the last sheet T forming a sheet bundle S has been fed until the first sheet T forming a subsequent sheet bundle S is fed.

With this configuration, by using the punching processing time, the stapling processing time, which would vary in accordance with the type of sheet T forming a sheet bundle S, the power supply voltage of a motor used for stapling processing, or the operating temperature, can be estimated with high precision. Accordingly, it is possible to set a sheet-bundle interval time to be provided between a current sheet bundle S and a subsequent sheet bundle S based on the estimated stapling processing time. Therefore, in the present disclosure, unlike the prior art, it is not necessary to set the sheet-bundle interval time by considering the maximum time to perform stapling processing, and thus, an unnecessarily long standby time does not have to be set, thereby optimizing the sheet-bundle interval time. As a result, the entire bookbinding processing time can be reduced, thereby improving the productivity of the overall processing.

Additionally, the estimated stapling processing time approximates the actual stapling processing time. Thus, it is possible to avoid disadvantages which would occur if the sheet-bundle interval time were reduced, that is, the occurrence of a paper jam caused by an interference of sheet bundles S.

In the multifunctional peripheral 100 of the above-described embodiment, the punching time measuring unit 306 measures punching processing times of a predetermined number (three) of sheets among a plurality of sheets T forming a sheet bundle S. With this configuration, if, for example, the sheets T forming the sheet bundle S are all plain paper, even if the estimated stapling processing time is calculated from the punching processing times of only some of the sheets T forming the sheet bundle S, it can still be calculated with high precision with errors of only several milliseconds, which can be safely ignored. Accordingly, measurements of the punching processing times of the remaining sheets T can be omitted, and, before punching processing has finished for all the sheets T forming the sheet bundle S, the estimated stapling processing time can be calculated and the sheet-bundle interval time can be set. As a result, it is possible to avoid a situation where the calculation of the estimated stapling processing time has not been made in time when the first sheet T of a subsequent sheet bundle S is fed. If such a situation can be avoided, the punching time measuring unit 306 may measure punching processing times of all sheets T forming a sheet bundle S.

The stapling time estimating unit 307 of the above-described embodiment utilizes the average measured punching processing times for calculating the estimated stapling processing time of a sheet bundle S having sheets T for which the punching processing times were measured. However, the average measured punching processing times may be used in another manner. For example, the stapling time estimating unit 307 may utilize the average of the punching processing times for calculating the estimated stapling processing time of a subsequent sheet bundle S. With this configuration, it is possible to avoid a situation where measurements of the punching processing times have not been made in time for calculating the sheet-bundle interval time.

In the multifunctional peripheral 100 of the above-described embodiment, the estimated stapling processing time is calculated by using the above-described arithmetic expression. However, the estimated stapling processing time may be calculated in another manner. For example, the estimated stapling processing time does not always exhibit a simple proportionality relation to the number of sheets T due to the type or the number of sheets T. Accordingly, arithmetic expressions may be experimentally calculated according to the type of or the number of sheet T and may be stored in the arithmetic expression storage unit 308. Then, the stapling time estimating unit 307 may calculate the estimated stapling processing time by referring to an arithmetic expression associated with the type and the number of sheet T. With this configuration, it is possible to approximate the estimated stapling processing time more closely to an actual stapling processing time.

In the multifunctional peripheral 100 of the above-described embodiment, as the sheet-bundle interval time, the time obtained by adding the estimated stapling processing time to the sheet interval time is used. However, another factor may be considered in setting the sheet-bundle interval time. For example, in actuality, after performing stapling processing on a sheet bundle S, a predetermined processing time may be generated for aligning a sheet bundle S and feeding it. Accordingly, if such a predetermined processing time is necessary, in addition to the estimated stapling processing time, such a predetermined processing time (alignment time and feed time) may be added to the sheet interval time, thereby setting the sheet-bundle interval time.

In the above-described embodiment, the multifunctional peripheral 100 is utilized when using a copying function. However, the multifunctional peripheral 100 may be utilized when, for example, a printing function including bookbinding processing, is used.

In the above-described embodiment, the above-described elements are included in the multifunctional peripheral 100. Alternatively, a program implementing the above-described elements may be stored in a storage medium, and the storage medium may be provided. With this configuration, the program is read from the storage medium to the multifunctional peripheral 100, and the multifunctional peripheral 100 implements the elements. In this case, the program itself read from the storage medium achieves the advantages of the present disclosure. Moreover, steps executed by the elements may be stored in a hard disk and may be provided.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming apparatus comprising:

a post-processing device configured to perform punching processing on a sheet on which an image is formed and stapling processing on a sheet bundle consisting of a plurality of punched sheets;

a punching time measuring unit configured to measure a punching processing time to perform the punching processing;

a stapling time estimating unit configured to calculate an estimated stapling processing time to perform stapling processing by using the punching processing time measured by the punching time measuring unit; and a sheet-bundle interval time setting unit configured to set, by using the estimated stapling processing time, a sheet-bundle interval time, which is a time from when the last sheet forming a sheet bundle subjected to the punching processing is fed until when the first sheet forming a subsequent sheet bundle subjected to the punching processing is fed.

2. The image forming apparatus according to claim 1, wherein:

the punching time measuring unit measures a punching processing time for each of a predetermined number of sheets among the plurality of sheets forming a sheet bundle; and the stapling time estimating unit calculates an average value of the measured punching processing times and calculates the estimated stapling processing time by using the calculated average value.

3. The image forming apparatus according to claim 2, wherein the predetermined number of sheets is less than the number of sheets forming the sheet bundle.

4. The image forming apparatus according to claim 1, wherein the stapling time estimating unit uses an arithmetic expression represented by $$Ts=(Ts0+\alpha*M)*Tpa/Tp0$$

where Ts is the estimated stapling processing time, Ts0 is a standard stapling processing time to perform predetermined stapling processing on one sheet of plain paper, $\alpha$ is a coefficient with respect to an increase in a stapling processing time per sheet, M is the number of sheets forming a sheet bundle, Tpa is an average value of the punching processing times, and Tp0 is a standard punching processing time to perform predetermined punching processing on one sheet of plain paper, and the stapling time estimating unit substitutes the average value Tpa of the punching processing times and the number of sheets M into the arithmetic expression, thereby calculating the estimated stapling processing time Ts.

5. A post-processing method for an image forming apparatus including a post-processing device that performs punching processing on a sheet on which an image is formed and stapling processing on a sheet bundle consisting of a plurality of punched sheets, the post-processing method comprising:

measuring a punching processing time to perform the punching processing by using a punching time measuring unit;

calculating an estimated stapling processing time to perform stapling processing by using the measured punching processing time by using a stapling time estimating unit; and setting, by using the estimated stapling processing time, a sheet-bundle interval time, which is a time from when the last sheet forming a sheet bundle subjected to the punching processing is fed until when the first sheet forming a subsequent sheet bundle subjected to the punching processing is fed, by using a sheet-bundle interval time setting unit.

6. The post-processing method according to claim 5, wherein:

the punching time measuring unit measures a punching processing time for each of a predetermined number of sheets among the plurality of sheets forming a sheet bundle; and the stapling time estimating unit calculates an average value of the measured punching processing times and calculates the estimated stapling processing time by using the calculated average value.

7. The post-processing method according to claim 6, wherein the predetermined number of sheets is less than the number of sheets forming the sheet bundle.

8. The post-processing method according to claim 5, wherein the stapling time estimating unit uses an arithmetic expression represented by $$Ts=(Ts0+\alpha*M)*Tpa/Tp0$$

where Ts is the estimated stapling processing time, Ts0 is a standard stapling processing time to perform predetermined stapling processing on one sheet of plain paper, $\alpha$ is a coefficient with respect to an increase in a stapling processing time per sheet, M is the number of sheets forming a sheet bundle, Tpa is an average value of the punching processing times, and Tp0 is a standard punching processing time to perform predetermined punching processing on one sheet of plain paper, and the stapling time estimating unit substitutes the average value Tpa of the punching processing times and the number of sheets M into the arithmetic expression, thereby calculating the estimated stapling processing time Ts.

* * * * *